US005365756A

United States Patent [19]

Nakamori et al.

[11] Patent Number: 5,365,756

[45] Date of Patent: Nov. 22, 1994

[54] FLAT KNITTING MACHINE HAVING SEPARATELY MOVABLE UPPER AND LOWER BEDS

[75] Inventors: Toshinori Nakamori; Ikuhito Hirai, both of Wakayama, Japan

[73] Assignee: Shima Seiki Mfg., Ltd., Wakayama, Japan

[21] Appl. No.: 167,000

[22] Filed: Dec. 16, 1993

[30] Foreign Application Priority Data

Dec. 17, 1992 [JP] Japan ..... 4-337329

[51] Int. Cl.[5] ..... D04B 15/10; D04B 15/12

[52] U.S. Cl. ..... 66/64; 66/69; 66/78; 384/42

[58] Field of Search ..... 66/64, 69, 78, 148, 66/189; 384/42

[56] References Cited

U.S. PATENT DOCUMENTS

| | | | |
|---|---|---|---|
| 3,054,645 | 9/1962 | Evans | 384/42 |
| 3,813,132 | 5/1974 | Sahm | 384/42 |
| 3,841,114 | 10/1974 | Vandermeirsch | 66/148 |
| 4,791,793 | 12/1988 | Goller et al. | 66/69 |
| 4,905,483 | 3/1990 | Shima | 66/69 X |
| 4,941,758 | 7/1990 | Osawa | 384/42 X |

*Primary Examiner*—Clifford D. Crowder
*Assistant Examiner*—John J. Calvert
*Attorney, Agent, or Firm*—Armstrong, Westerman, Hattori, McLeland & Naughton

[57] ABSTRACT

A flat bed knitting machine has two beds supported on either side of a central knitting region. The upper bed is supported on the lower bed by a series of specifically shaped needle plates which extend upward from the a grooved plate bed. The shape of the plates allows the upper bed to slide in separate movement from the lower bed. The shape of the supports also allowing for mounting and removal of the upper needle bed from the lower bed.

6 Claims, 21 Drawing Sheets

FLAT KNITTING MACHINE HAVING SEPARATELY MOVABLE UPPER AND LOWER BEDS

BACKGROUND OF THE INVENTION

1. Field of the Invention

The present invention relates to a flat knitting machine having transferring jacks or upper needle beds disposed above needle beds.

2. Description of the Related Art

In a usual flat knitting machine, a pair of needle beds which contain movable knitting needles are arranged to form an inverted V-shaped form in a side view. In knitting a rib knit fabric by using front and rear knitting needles of this flat knitting machine, it is impossible to decrease stitches at an intermediate portion in a row of stitches.

To solve this problem, Japanese Examined Patent Publication No. 47-7907 discloses a flat knitting machine, wherein a pair of needles beds, containing movable knitting needles, are arranged to form an inverted V-shaped form in a side view. A transferring jack bed, containing movable jacks in jack grooves, is provided above each needle bed. A stitch to be transferred is transferred from the knitting needle to the transferring jack, and the stitch engaged with the transferring jack is transferred to another knitting needle after the transferring jack engaged with the stitch is moved in a transverse direction.

However, in the transferring jack bed supporting structure of the stitch transferring mechanism of a flat (weft) knitting machine described in the above publication, there is a problem that a central part of the transferring jack bed sags due to its own weight, because the transferring jack is supported at its opposite ends.

To prevent the sagging of a transferring jack bed, the transferring jack bed is reinforced in various ways or, as described in Japanese Examined Patent Application (laid open application for opposition) No. 41-7907, an upper needle bed can be supported by a knitting needle suppressing plate mounted on a lower needle bed. In such case, however, there is a problem that transferring jack bed and the knitting needle suppressing plate must be removed, for example, when replacing a knitting needle of the lower needle bed. This lowers work efficiency.

SUMMARY OF THE INVENTION

The present invention overcomes the above problem by providing a flat knitting machine, where a needle bed, or a transferring jack bed disposed above a needle bed, can be supported without sagging and a knitting needle in a lower needle bed can be easily replaced in a short time.

To achieve the above object, a flat knitting machine of the present invention comprises two needle beds making up an upper needle bed and a lower needle bed. Plate grooves are engraved on an upper face of each of the needle beds. Needle plates are mounted in each of the plate grooves and are provided with a needle groove formed between the needle plates. A part of one of the needle plates is extended upward, and a transferring jack bed, or the upper needle bed is supported by a part of the one of the needle plates which is a supporting part. The upper needle bed or the transferring jack bed is movable in a longitudinal direction of the lower needle bed in the supporting part.

A flat knitting machine of the present invention further comprises a dovetail protruding object, formed in either the supporting part or one of the upper needle bed and the transferring jack bed, and a dovetail groove to fit the dovetail protruding object is formed on the other of upper needle bed and transferring jack bed. The dovetail protruding object and the dovetail groove are movably fitted.

A flat knitting machine of the present invention may further comprises a space for removing and mounting the dovetail protruding object, the space being formed in the dovetail groove.

In this flat knitting machine, the carriage moves reciprocally on the needle bed. The knitting needles are moved forward and backward in the needle grooves because the cam surface acts on each butt of the predetermined knitting needles. Knitted goods with a predetermined width are knitted by feeding yarn from the yarn feeder.

When stitched are reduced inward to reduce the width of the knitted goods, the stitch to be moved inward is transferred from the knitting needle to the transferring jack. In this case, the knitting needle which retains the stitch is pushed forward toward the transferring portion by the carriage. The needle selected member of the transferring jack which should receive the stitch is selected by the needle selecting means. The transferring jack which was selected is moved forward and backward. The stitch to be moved inward is transferred from the knitting needle to the transferring jack.

The upper needle bed or the transferring jack bed, as the case may be, is supported at an upper part of a supporting part extended from a part of a specific needle plate forming a needle groove. A knitting needle of the lower needle bed can be easily replaced only by removing the suppressing plate. Besides, the upper needle bed or the transferring jack bed, as the case may be, is firmly supported at the supporting part and does not sag due to its own weight.

A knitting needle of the upper needle bed or a transferring jack, to which a stitch is transferred, and at least a part of stitches engaged with needles of the needle bed, from which a stitch is transferred, move relative to each other in an over-wrapping transverse direction, but where a dovetail protruding object is formed in either the upper needle bed or a lower face of the transferring jack bed, and a supporting part, having a dovetail groove to fit the protruding dovetail, is formed on another part where the dovetail protruding object is not formed, and the dovetail protruding object and the dovetail groove are fitted so as to relatively movable in a longitudinal direction of the needle bed or the transferring jack bed, the upper needle bed or the transferring jack bed and the needle bed move relatively to each other along the fitting part of the dovetail type.

Thereafter, a stitch is transferred from the transferring jack to the needle bed and inner reduction is completed.

In case where a transferring jack bed or needle bed above the supporting part is removed or mounted in order to replace a knitting needle, to inspect a lower needle bed or to replace a transferring jack bed or a needle bed supported at the upper face of the supporting part, the upper needle bed, or the transferring jack bed, can be easily removed from the supporting part if the transferring jack bed, or the upper needle bed of the supporting part, is lifted, keeping the dovetail protruding object and the space for removing and mounting formed in the dovetail groove.

DESCRIPTION OF THE PREFERRED EMBODIMENTS

First, a first embodiment of the present invention is described.

Figure 1:
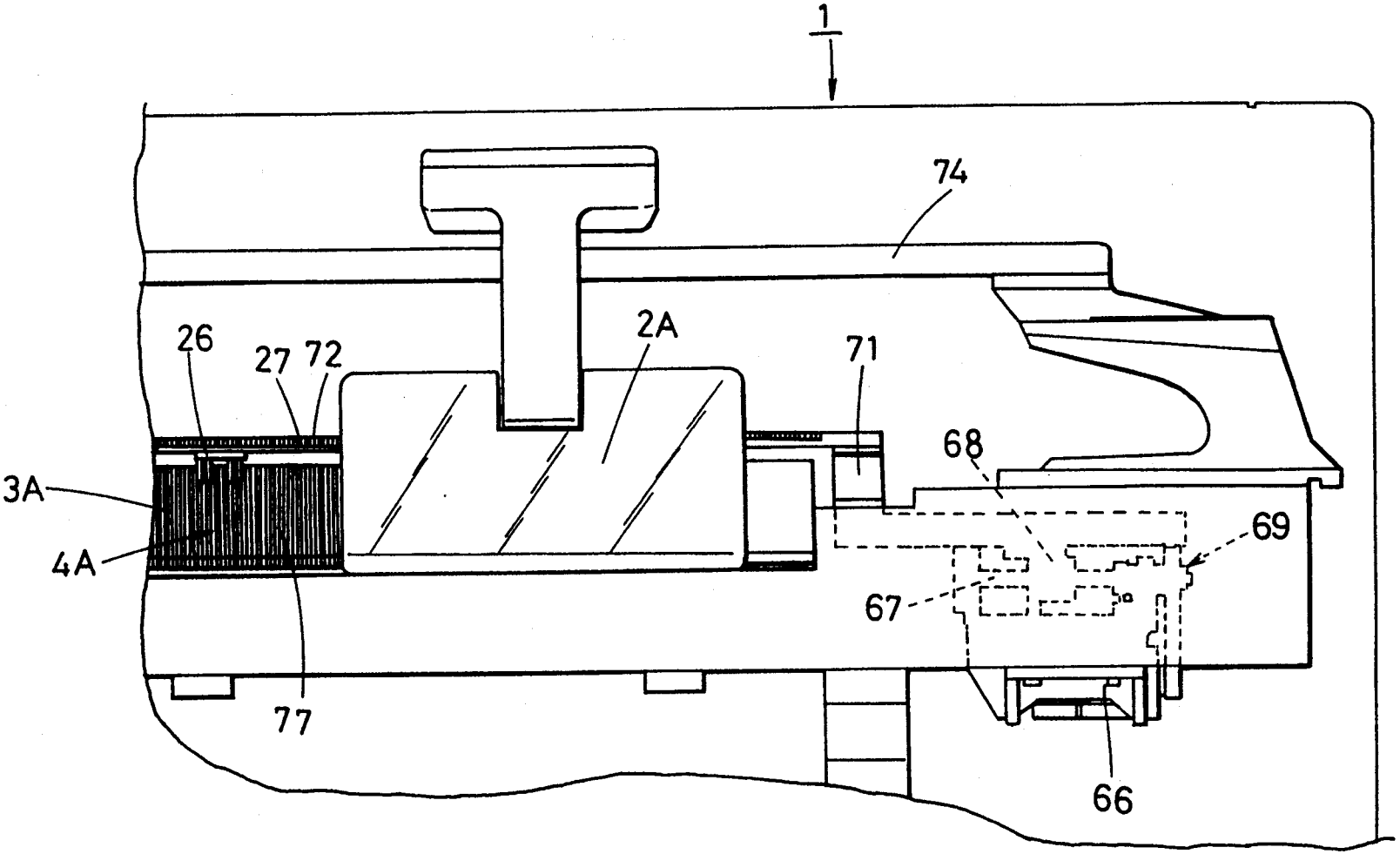
FIG. 1 is a schematic partly cross sectional elevational view of a flat knitting machine of the present invention.
Figure 2:
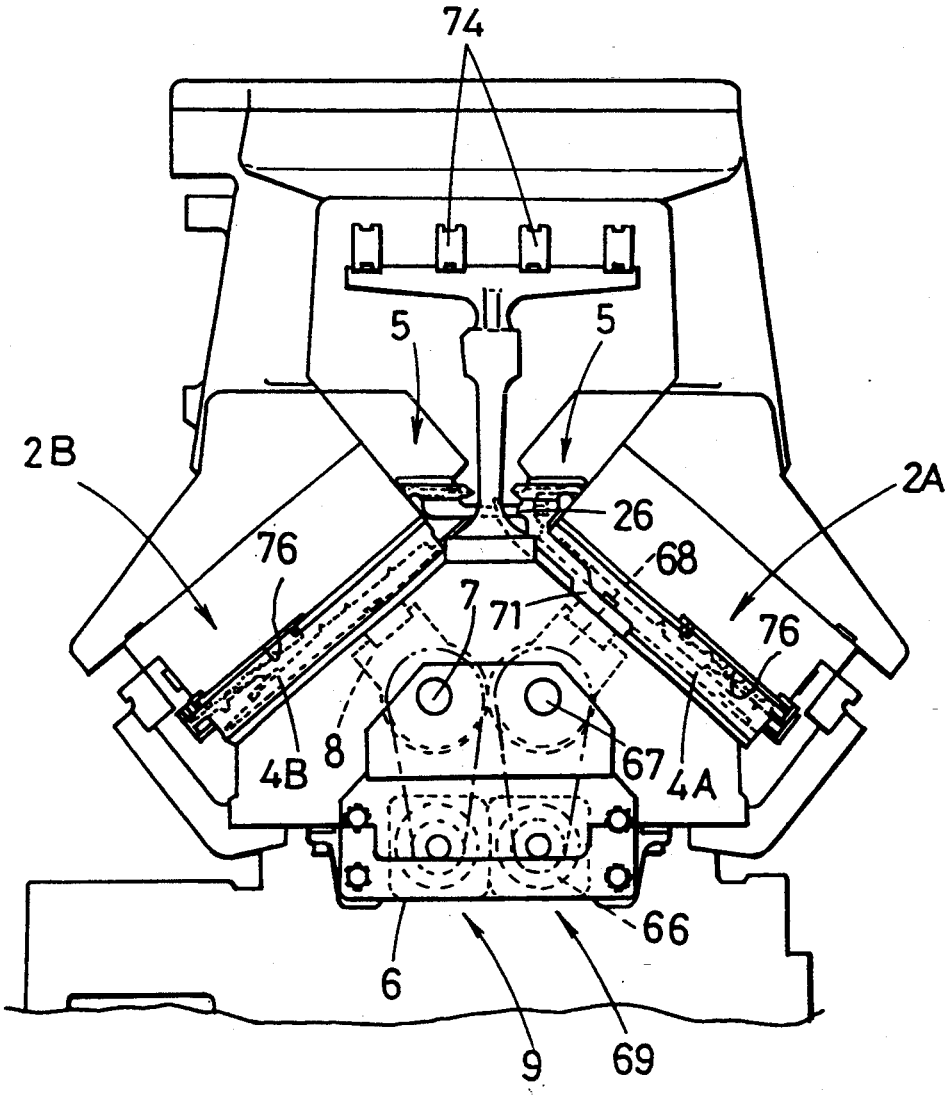
FIG. 2 is a schematic partly cross sectional side view of a flat knitting machine of the present invention.
Figure 3:
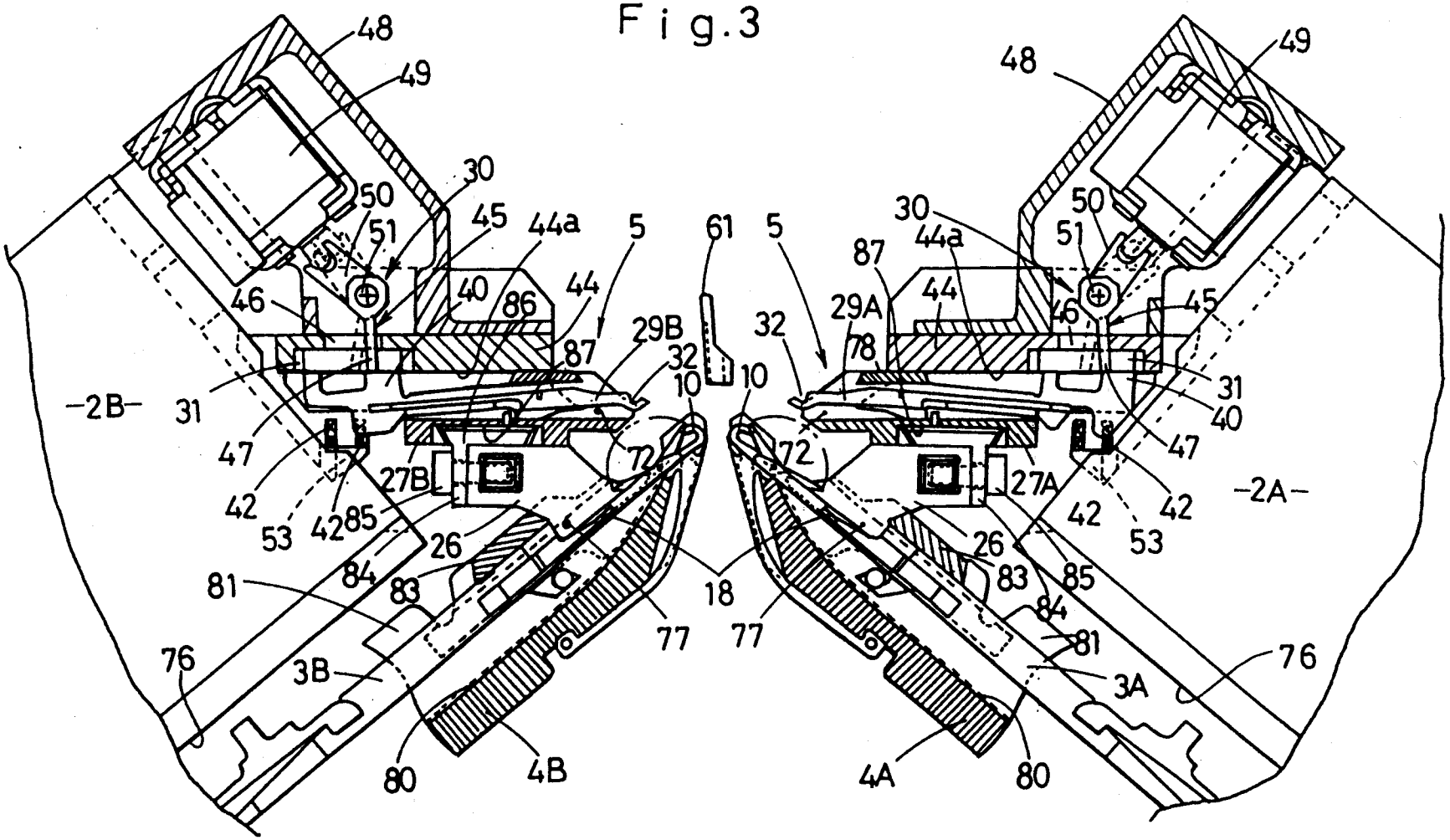
FIG. 3 is a schematic enlarged cross sectional side view of the principal part of a flat knitting machine of the present invention.

FIG. 1 is a schematic elevational view of a first embodiment of a flat knitting machine having a transferring mechanism, FIG. 2 is a side view of FIG. 1, and FIG. 3 is an enlarged cross-sectional side view of FIG. 2.

Referring to FIG. 1 through FIG. 3, reference numeral 1 designated the flat knitting machine. The knitting machine 1 comprises a flat front lower needle bed 4A and a flat rear lower needle bed 4B which are arranged facing each other to form an inversed V-shaped form in a side view, and each transferring mechanism 5 arranged above each needle bed 4A, 4B respectively. In each of the needle beds 4A, 4B, a number of knitting needles 3A, 3B, FIG. 3 are arranged, respectively, so as to be movable in needle grooves 77 by carriage 2A, 2B. The rear needle bed 4B is movable in transverse direction by a driving means which comprises a motor 6, a driving screw shaft 7, a slider 8, and the like (see FIG. 2).

Figure 4:
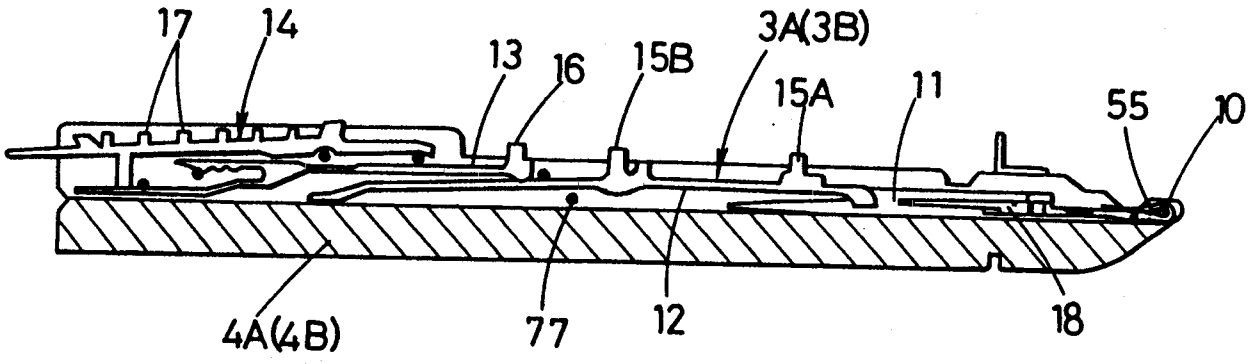
FIG. 4 is a cross sectional side view of the portion involving the knitting needle of a flat knitting machine of the present invention.

Referring to FIG. 4, knitting needle 3A or 3B arranged in the needle groove 77 of the needle bed 4A or 4B comprises a knitting needle body 11 at the end of which a hook 10 is formed, a jack 12 which is connected to the rear end portion of the knitting needle body 11, a selecting jack 13 arranged at the rear portion of the jack 12, and a selector 14 arranged on the selecting jack 13. Butts 15A and 15B are projected upwardly from the jack 12, butt 16 is projected upwardly from the selector 14. When butts 15A, 15B, 16, and 17 move along a cam surface 76 of the carriages 2A, 2B, the jack 12, the selecting jack 13, and the selector 14 move in the needle groove 77.

An expanding member 18 for expanding a loop retained by the knitting 3A or 3B is arranged at a one side of the knitting needle body 11. The expanding member 18 is formed by bending sheet metal into a boat like shape, in plan view and the end of the expanding member 18 is fixed to the one side of the knitting needle body 11.

Figure 5:
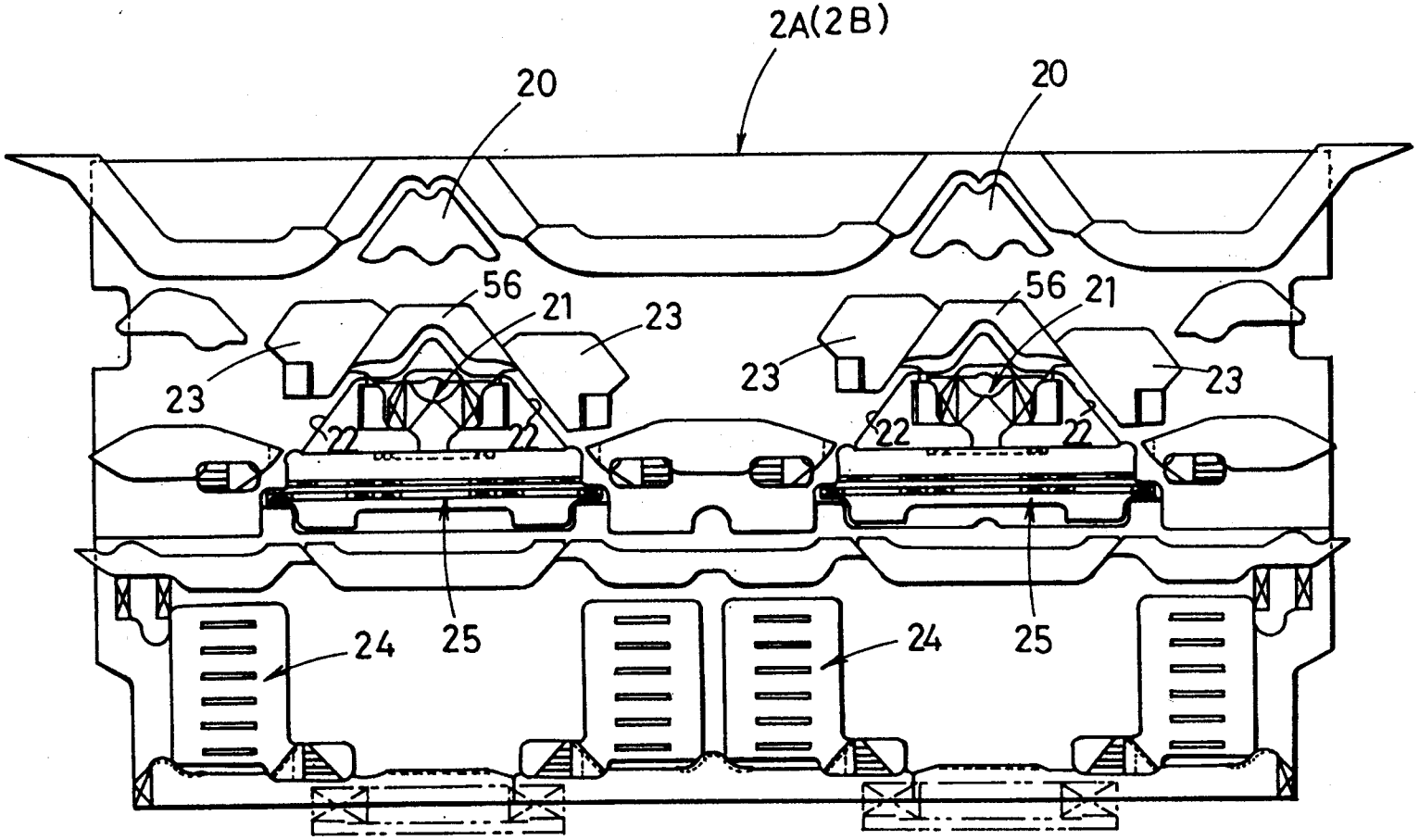
FIG. 5 is a schematic elevational view of the group of cams of the carriage of a flat knitting machine of the present invention.

Referring to FIG. 5, group of cams of the carriages 2A and 2B over the needle beds 4A and 4B comprises two cam units arranged side by side. The cam unit comprises a transferring raising cam 20 protruded and retracted by a solenoid or a motor (not shown), a substantially trapezoid transferring receiving cam 21 arranged under the transferring raising cam 20, and can be protruded and retracted, needle raising cams 22 formed at the sides of the transferring receiving cams 21, and a convex portion 23 at the side of the needle raising cams 22. Under the group of cams, a needle selecting actuator 24 which acts on butts 17 of the selector 14 of the knitting needles 3A and 3B is arranged. Between the needle selecting actuator 24 and the group of cams, a pressor mechanism 25 which acts the butt 16 of the selecting jack 13 of the knitting needles 3A and 3B so that the knitting needles 3A and 3B are located at the position for knitting tucks or for transferring.

A stitch transferring mechanism 5, formed between the carriage 2A(2B), comprises a supporting part 26 formed on an upper face of needle beds 4A(4B), as shown in FIG. 3, transferring jack beds 27A(27B) supported by the supporting part 26, transferring jack 29A(29B) movably contained by jack groove 72 of transferring jack beds 27A(27B), a needle selecting mechanism 30 to select the transferring jack 29A(29B) and a stitch transferring cam 31 to operate the transferring jack 29A/29B forward and backward.

The transferring jack beds 27A(27B) and the needle beds 4A(4B) are relatively operated in position, as a operating bracket 71, connecting the respective ends of the both transferring jack beds 27A(27B), moved in a transverse direction by a driving means 69, constituted by a motor 66, a driving screw spindle 67, a slider 68, etc. (see FIG. 1).

Figure 6:
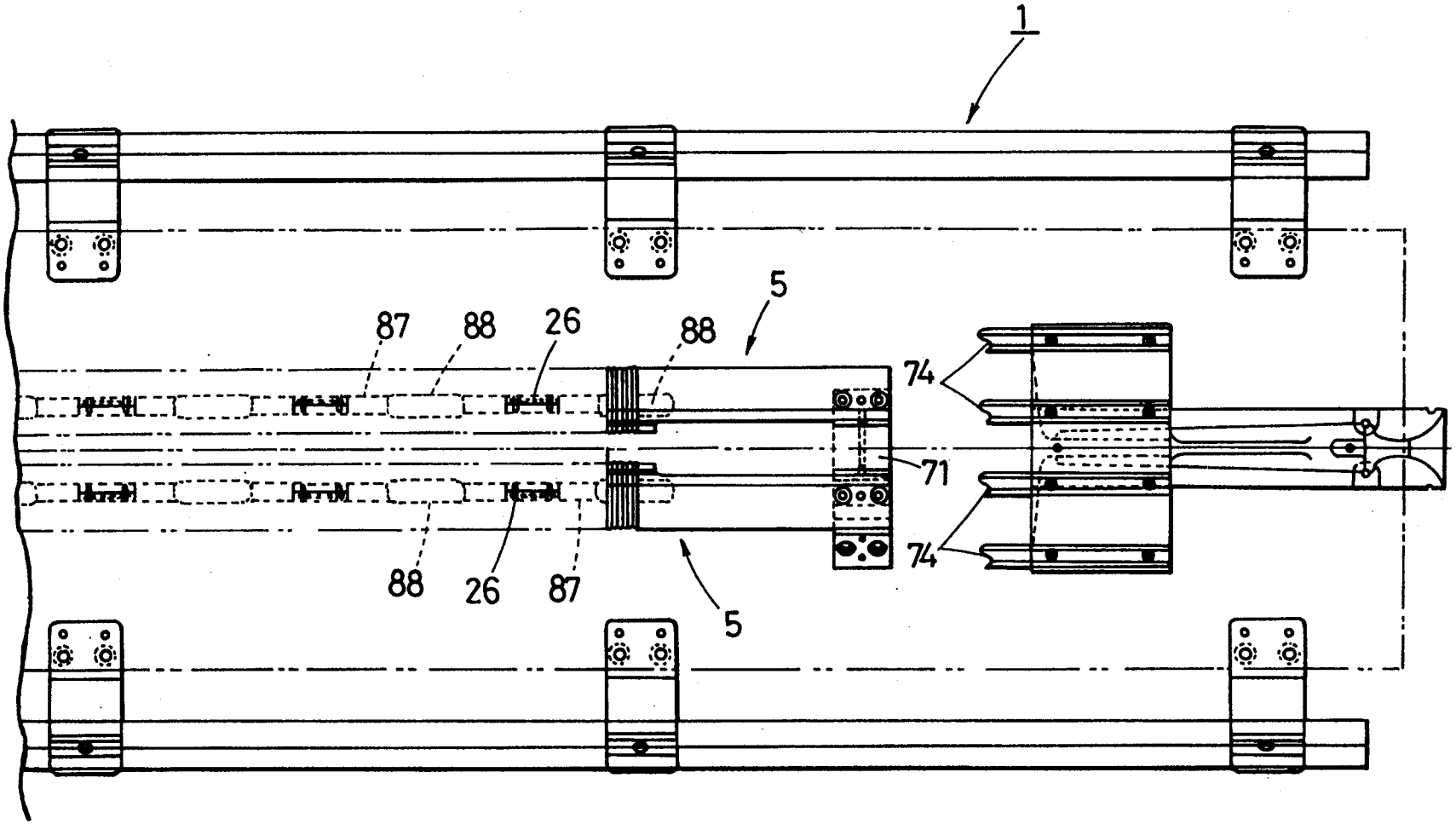
FIG. 6 is a schematic plan view of the portion involving the transferring mechanism of a flat knitting machine of the present invention.
Figure 7:
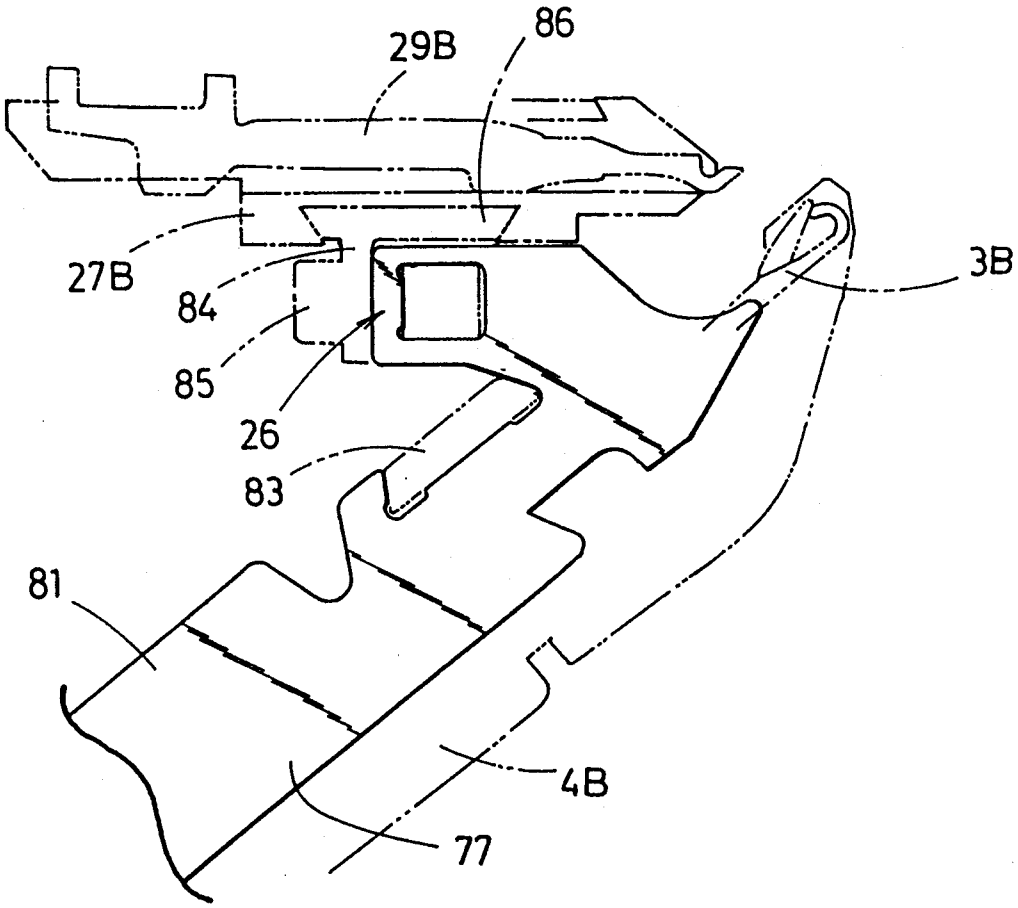
FIG. 7 is a schematic plan view of the supporting part of a flat knitting machine of the present invention.
Figure 8:
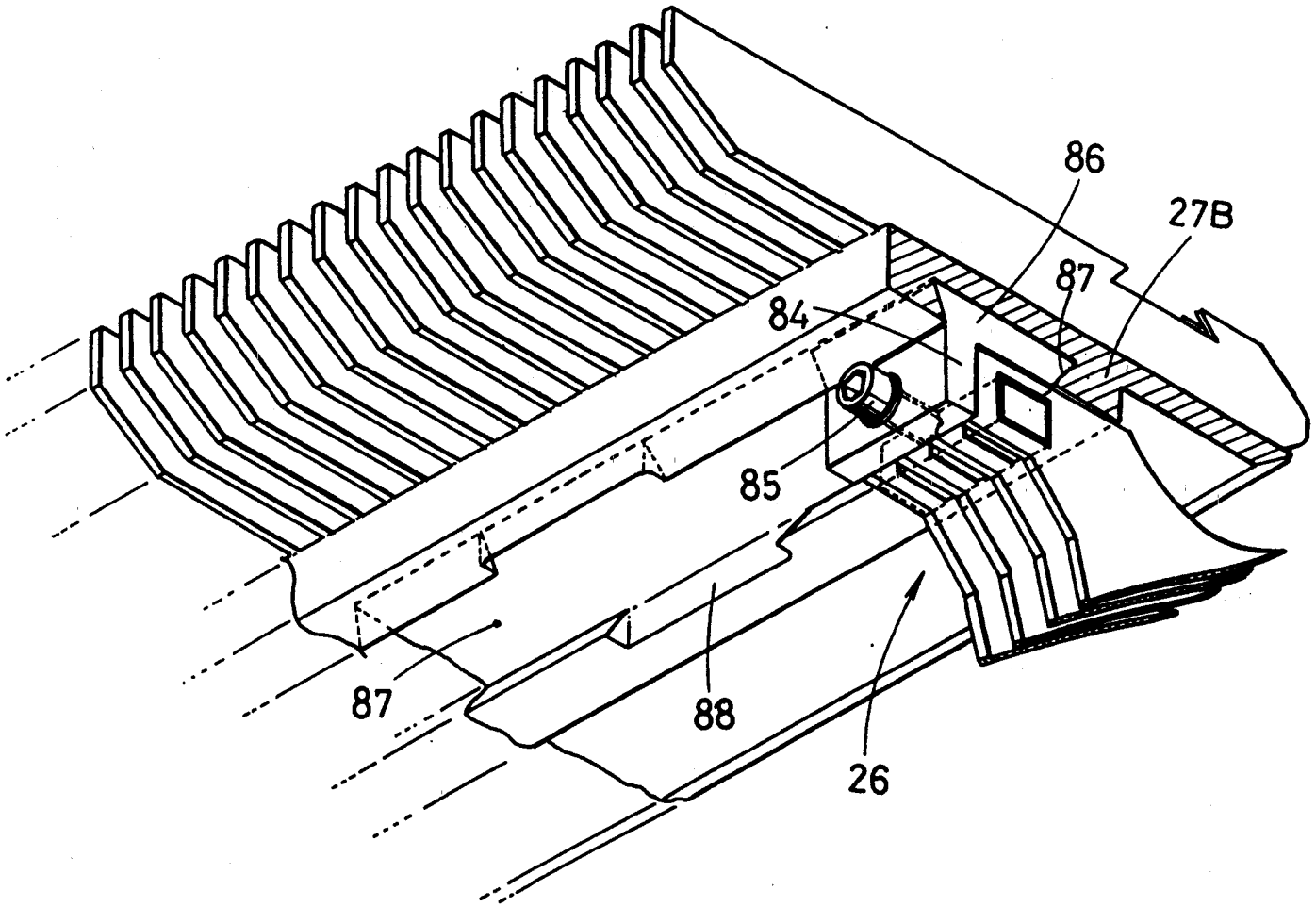
FIG. 8 is a base view of the supporting part of a flat knitting machine of the present invention.

The above described supporting part 26 is formed, as follows. Plate grooves 80 are engraved, in parallel, with equal intervals, on an upper face of needle beds 4A/4B. Needle grooves 77, for containing knitting needles 3A or 3B, are formed between the needle plates 81, the lower part of which is inserted in the plate grooves 80 to stand vertically. Knitting needles 3A or 3B, contained in the needle groove 77, are suppressed from the upper side, to prevent the knitting needles from coming out, by a knitting needle supporting plate 83 mounted to fit on all of the needle plates 81. The supporting part is formed mounting on specific needle plates 81 at mouth side part from knitting needle suppressing plate 83. A fitting member 84, shaped in a inverted L, is fixed, with a bolt 85, to an end face of the supporting part 26, as shown in FIGS. 6–8. The supporting part is formed with a protruding object 86, shaped in an inverted dovetail for fitting, positioned at upper part of the fitting member 84 and a groove 87, shaped in a dovetail which fits the aforementioned protruding object 86 positioned at the lower part of the transferring jack beds 27A(27B). The protruding object 86 and the groove 87 are movably fitted.

Where the supporting part 26 is placed off the knitting needle suppressing plate 83, fitted to cover all the needle plate 81 long as described above, the knitting needle 3A(3B) can be replaced only by removing the knitting needle suppressing plate 83 or pulling out the knitting needle suppressing plate 83 up until the needle, to be replaced when some knitting needles 3A(3B) should be replaced in the needle beds 4A(4B).

Further, a recess 88, for mounting and removing the dovetail protruding object 86, is cut on the dovetail groove 87 at a position beyond the usual moving range, and the recess 88 is formed at such a position as the dovetail protruding object 86 meets the recess when the transferring jack bed 27A(27B) is shifted, in a transverse direction, beyond a usual moving range to knit a texture.

Accordingly, the transferring jack bed 27A(27B) can be easily removed upward when the dovetail protruding object 86 meets the recess 88.

Additionally where the supporting part 26 is formed with a dovetail protruding object 86 and a dovetail groove 87, as in this embodiment, even when the dovetail protruding object 86 and the dovetail groove 87 fitting the object 86 become loose due to wearing, it can be easily avoided by unfastening the bolt 85 to lower the fitting member 84 and adjusting the relative position between the dovetail protruding object 86 and the dovetail groove 87.

Figure 9:
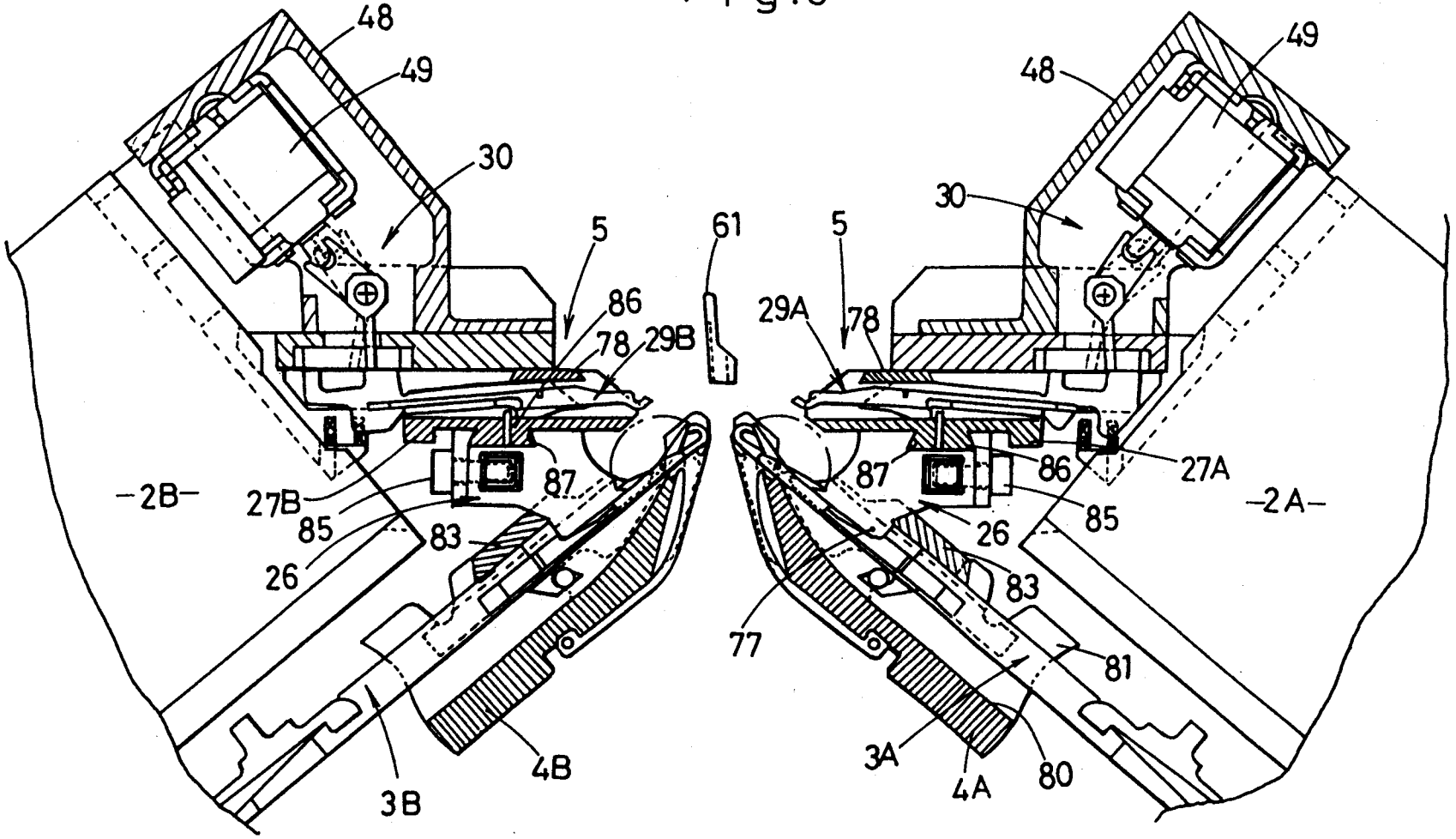
FIG. 9 is a schematic enlarged cross sectional side view of the principal part of a flat knitting machine according to FIG. 3 showing other example of a support part.
Figure 10:
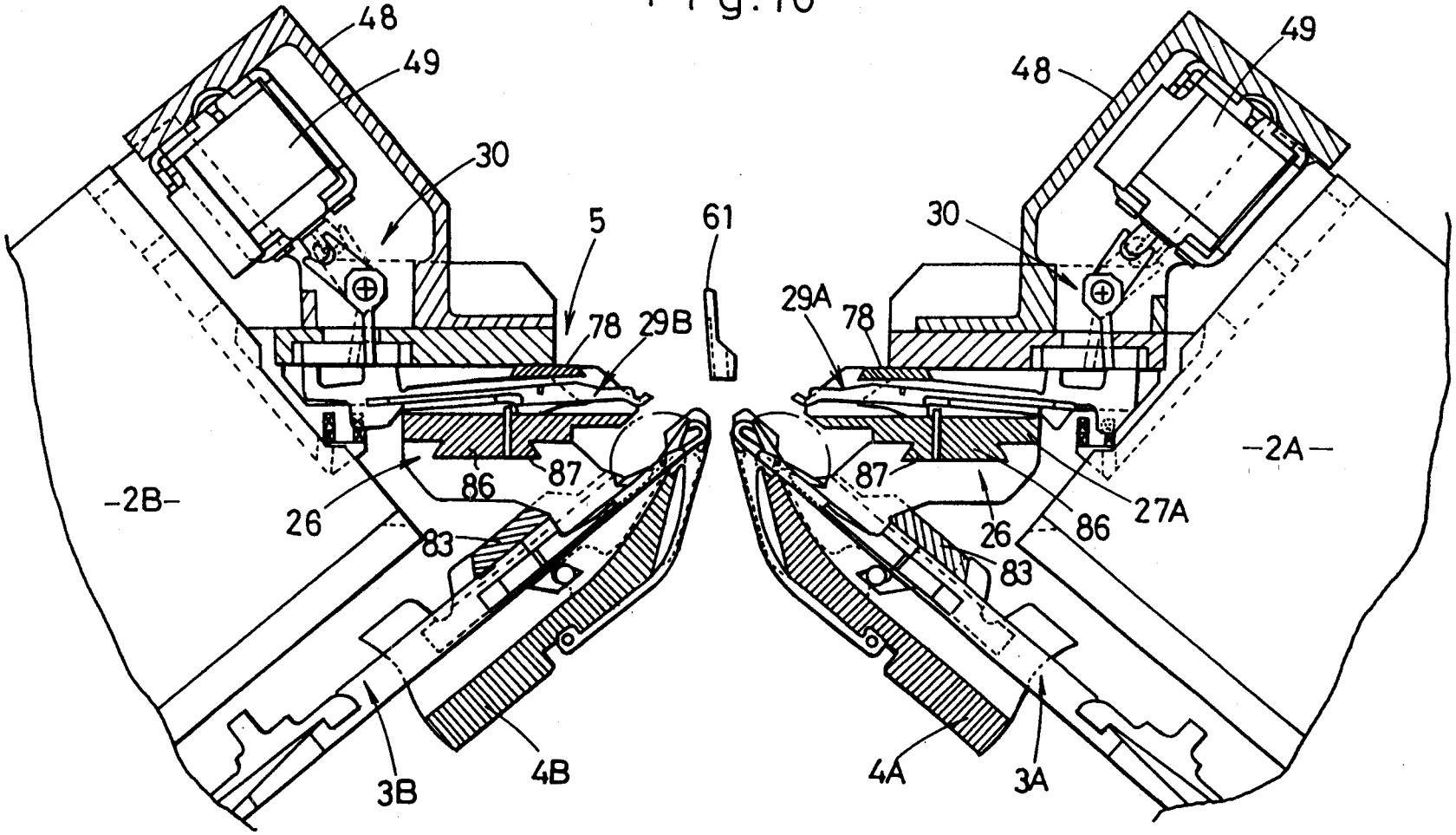
FIG. 10 is a schematic enlarged cross sectional side view of the principal part of a flat knitting machine according to FIG. 3 showing other example of a supporting part.

In this embodiment, a dovetail protruding object 86, shaped in an inverted trapezoid, is formed on an upper face of the fitting member 84 and a dovetail groove 87 is formed on a lower face of the transferring jack bed 27A(27B). A dovetail groove 87 may be formed on an upper face of the fitting member 84 and a dovetail protruding object 86 may be formed on a lower face of the transferring jack bed 27A(27B), as shown in FIG. 9, and also the fitting member 84 can be omitted, as shown in FIG. 10.

In the flat knitting machine having the above structure, by the needle beds 4A, 4B and the transferring mechanism 5, a stitch engaged with the knitting needle 3A on the front needle bed 4A can be transferred to the knitting needle 3B on the rear needle bed 4B or to a transferring jack 29A or 29B (referred to hereinafter) on the transferring jack bed 27A or 27B of the transferring mechanism 5. Also a stitch engaged with the knitting needle 3B on the rear needle bed 4B can be transferred to the knitting needle 3A on the front needle bed 4A or to the transferring jack 29A or 29B on the transferring jack bed 27A or 27B of the transferring mechanism 5.

In the transferring jack beds 27A and 27B, jack grooves 72 in which the transferring jack 29A and 29B are movably positioned are formed. The transferring jack beds 27A and 27B are suppressed from the upper side to prevent the transferring jack beds from coming out by a suppressing plate 78.

Figure 11:
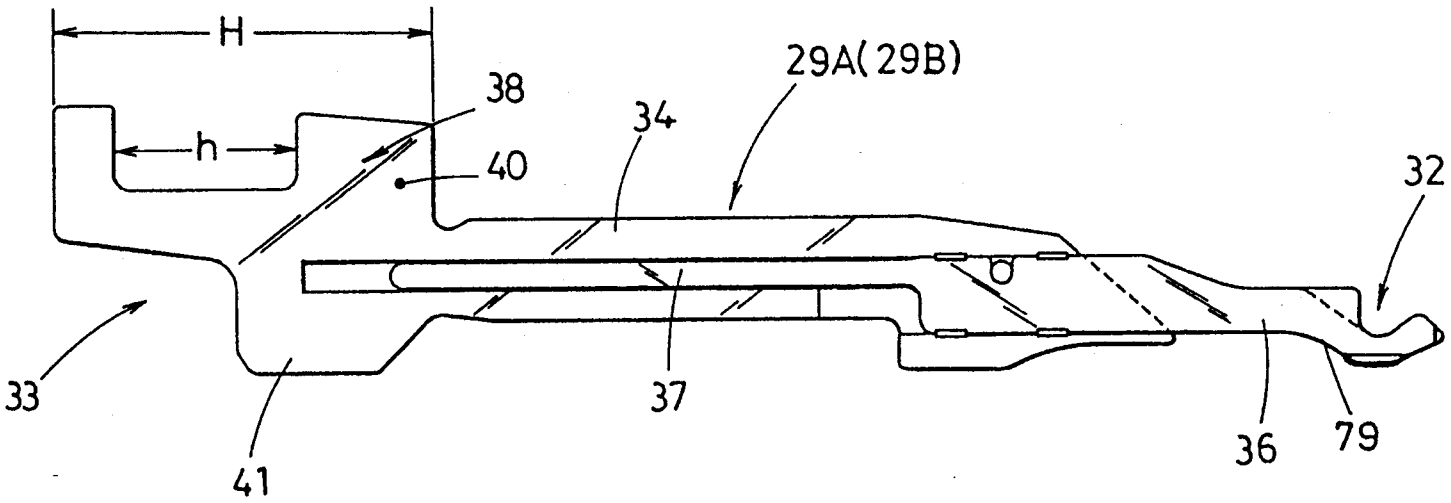
FIG. 11 is a side view of the transferring jack of a flat knitting machine of the present invention.
Figure 12:
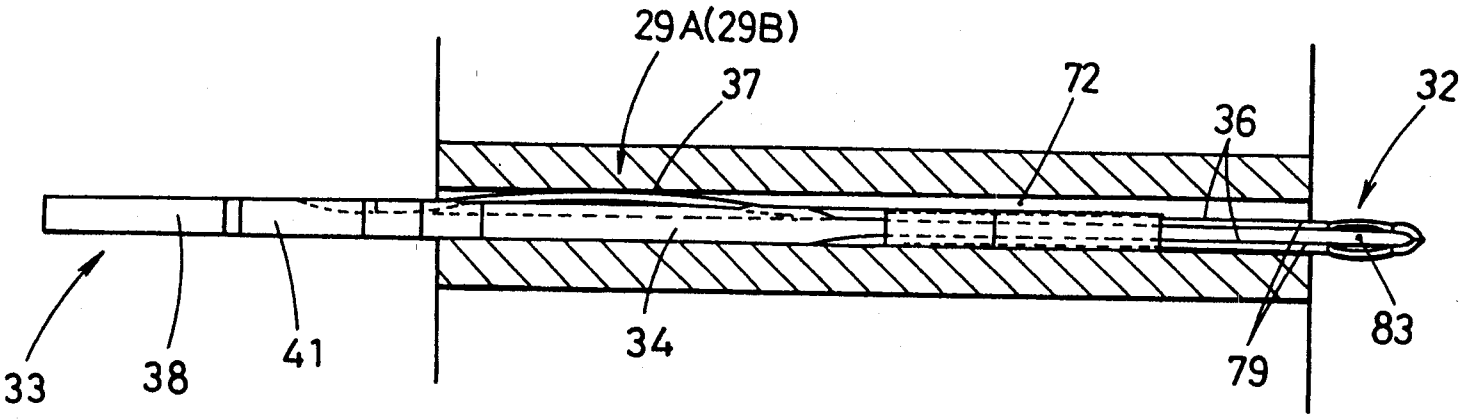
FIG. 12 is a bottom plan view of the transferring jack of a flat knitting machine of the present invention.
Figure 13:
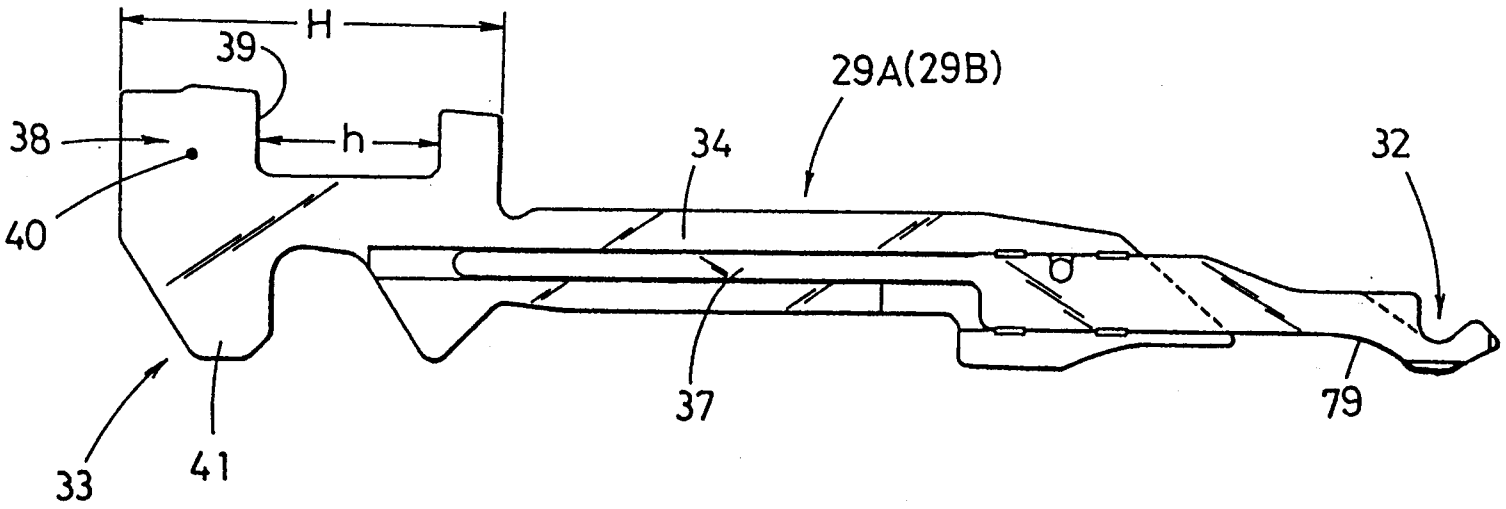
FIG. 13 is a side view of the transferring jack of a flat knitting machine of the present invention.

Referring to FIG. 11 through FIG. 13, a hook shaped stitch engaging portion 32 is formed at the front end of the transferring jack 29A (29B), a needle selected member 33 is formed at the rear end of the transferring jack 29A (29B), and a curved portion 79 is formed at the jack body 34 side of the stitch engaging portion 32.

Two strip members 36, as shown in FIGS. 11 and 12, made from spring steel are extended from the opposite side portion of the jack body 34. The tip end portions of the strip members 36 are curved so that the tip of the strip member 36 contacted each other. The tip end portions of the strip members 36 are formed into hook shape to form a stitch engaging portion 32. One or both strip members 36 is curved near the opposite end portion of the strip member 36 to form a spring portion 37.

The needle selected member 33 comprises a plate 38 with a length H, and a return butt 41 with which a return cam 42 (referred to hereinafter) acts. At the plat 38, a groove, with a width h, is formed and forms a needle selected butt 40. The position of the needle selected butt 40 in FIG. 11 is different from needle selected butt 40′ in FIG. 13, that is, the needle selected butts 40 in FIG. 11 and the needle selected butt 40 in FIG. 13 have different phases. According to this difference, the position of the return butt 41 in FIG. 11 is also different from the return butt 41′ in FIG. 13. Transferring jack groups are formed from a plurality of transferring jacks 29A (29B) having the same needle selected members 33 transferring jack groups of different selected members 33, 33′ are arranged, alternatively, every 1 inch.

In the above embodiment, the transferring jack 29 is made by mounting a spring steel 36 on the both sides of the jack body 34 and forming a stitch engaging portion 32, at the distal end of the spring steel 36, protruding from the jack body 34. The stitch engaging portion 32 and the jack body 34 can be integrally formed as FIG. 14.

Referring to FIG. 3, the transferring cam 31 for acting the needle selected butt 40, 40′ of the needle selected member 33, 33′ as the case maybe and the return cam 42 for acting the return butt 41, 41′ are arranged at the space between the carriage 2A (2B) on the needle bed 4A (4B) and a yarn guide arranged over an aperture between the needle beds 4A and 4B.

Figure 15:
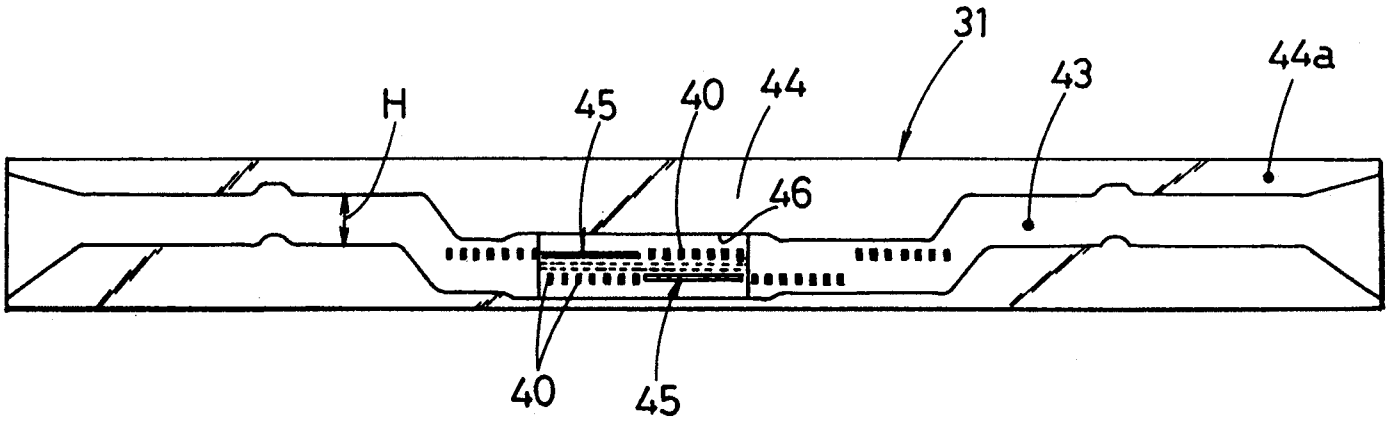
FIG. 15 is an elevational view of the transferring cam of a flat knitting machine of the present invention.

Referring to FIG. 15, the transferring cam 31 has a cam plate 44. A cam groove 43 with a width H is formed on the lower surface 44*a* of the cam plate 44 and the cam plate 44 protruded from the side portion of the carriage 2A (2B) so that the lower surface 44*a* of the cam plate 44 is slidable on the upper surface of the transferring jack bed 27A (27B). The return cam 42 for acting the return butt 47, 41' is fixed to a bracket 55 which is fixed to the side portion of the carriage 2A (2B).

Further, an operation opening 46 is cut at a central part of the cam groove 43 of the above described cam plate 44 to expose the operating part of the actuator 45 of the needle selecting means 30 for operating a needle selecting butt 40.

Figure 16:
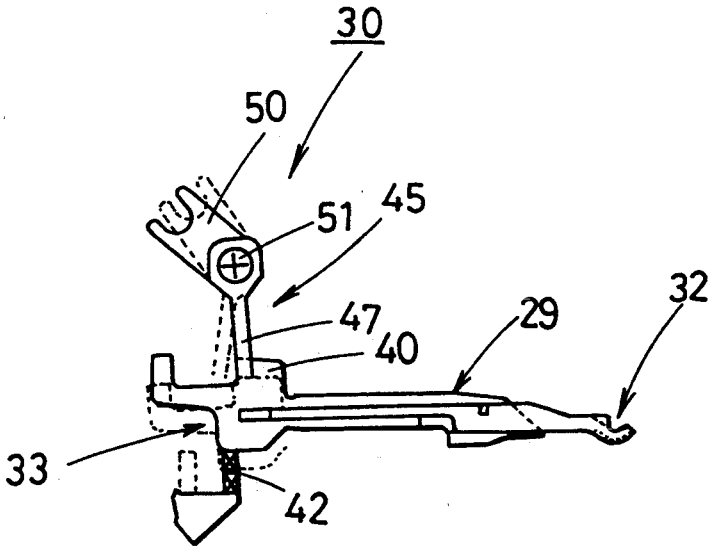
FIG. 16 is a side view of the principal part illustrating the action of the transferring jack in FIG. 11 of a flat knitting machine of the present invention.
Figure 17:
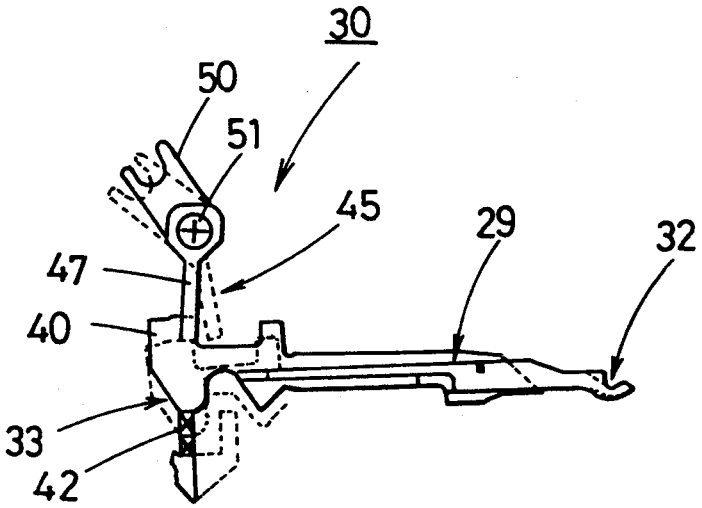
FIG. 17 is a side view of the principal part illustrating the action of the transferring jack in FIG. 13 of a flat knitting machine of the present invention.

Referring to FIG. 3, needle selecting means 30 comprises a solenoid 49, a swinging lever 50, supporting axis 51, and a needle selecting cam plate. The solenoid 49 is fixed to casing 48 which is fixed to the carriage 2A (2B). The solenoid 49 is connected to the one each of the swinging lever 50 and the other end thereof is fixed to the supporting axis 51. The needle selecting cam plate 47 which passes through the operation hole 46 and operates as the operating portion of the actuator 45 is also fixed to the supporting axis 51. Different needle selecting means 30 are arranged in transferring jack bed 27*a* or 27*b*, respectively, corresponding to the transferring jacks 29A (29B) (SEE FIG. 16 and FIG. 17).

Figure 18:
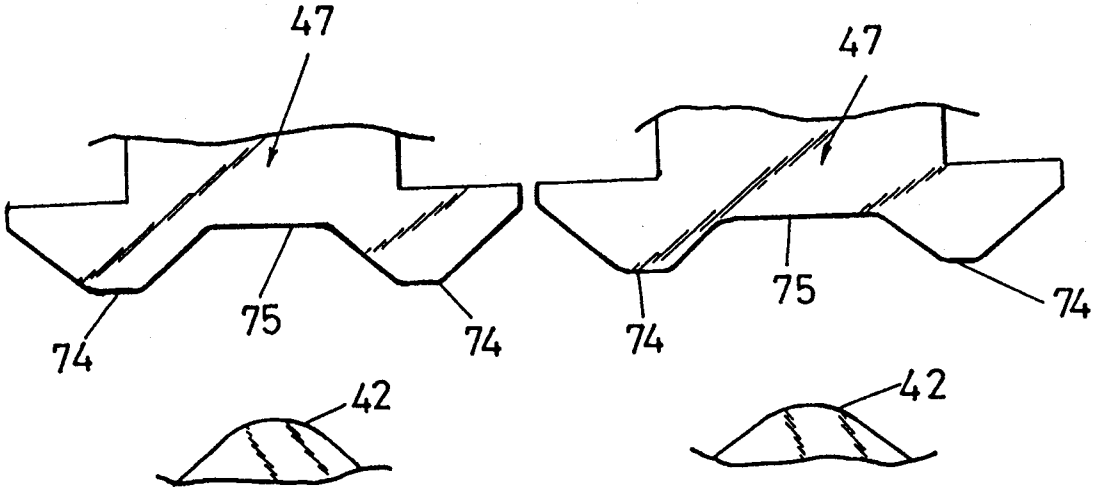
FIG. 18 is a partly cross sectional elevational view of the cam plate and the return cam of a flat knitting machine of the present invention.

Referring to FIG. 18, at the low end portion of the cam plate 47, convex portions 74 are formed at the opposite ends of the lower end portion and a recess portion 75 is formed between the convex portions 74. Return cam 42, for acting the return butt 41 of the transferring jack 29A (29B), is arranged at the position facing to the recess portion 75.

The operation of the flat knitting machine will be explained as follows:

When the carriage 2A (2B) moves reciprocally on the needle bed 2A (2B), because each butt 15A, 15B, or 16 of the knitting needle 3A or 3B is operated by the cam surface 76 of the carriage 2A or 2B, the knitting needle 3A or 3B is moved reciprocally in the needle groove 77 and, thus, knitted goods are knitted by feeding yarn from a yarn feeder 61.

With usual knitting, the solenoid 49 of the needle selecting means 30 of the transferring mechanism 5 maintains the swinging lever 47 in a standing position and therefore the needle selected butt 40 which is in a waiting position is pushed downwardly not to by operated by the cam groove 43 of the cam plate 44 even though the carriage 2A (2B) moves. The needle selected butt 40 which is pushed downwardly in a unoperated position is returned to the waiting position again by the return cam 42.

Accordingly, when the carriage 2A (2B) passes the edge portion of the knitting goods, because the needle selecting means 30 of the transferring mechanism 5 exists outside of the transferring jack 29A (29B) to be selected and the needle selected butts 40 of the transferring jacks 29A (29B) do not prevent the carriage 2A (2B) from moving even through the carriage 2A (2B) is moved in an adverse direction.

The case in which stitch is reduced is explained as follows. For convenience, the case in which the stitch 52 engaged to the front knitting needle 3A is transferred to the adjoining front knitting needle 3A is explained referring to FIG. 19 through FIG. 22.

Figure 19:
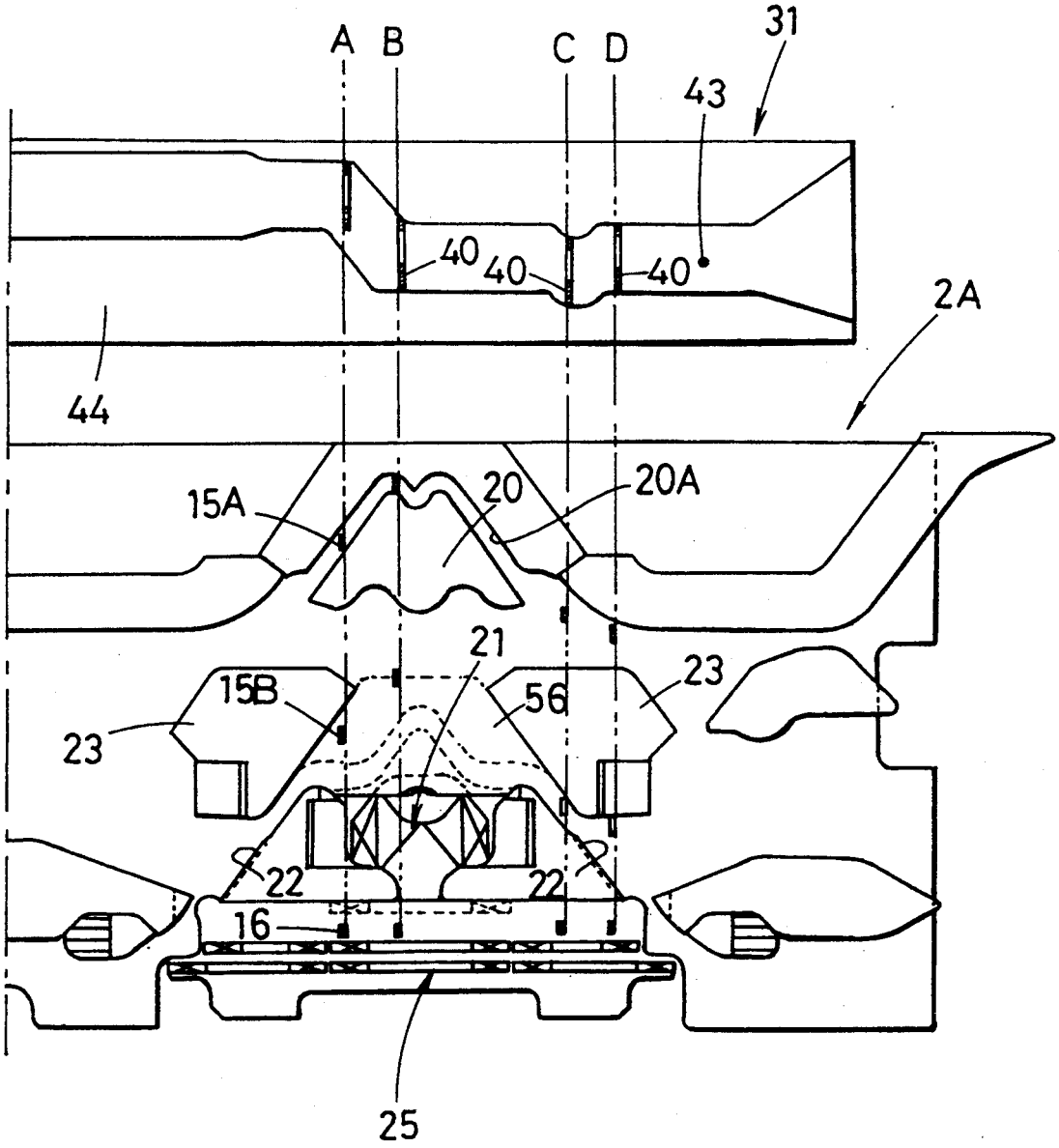
FIG. 19 is an elevational view illustrating the groups of the cams of the carriage and the relationship between positions of the cam groove of the transferring cam and the knitting needle of a flat knitting machine of the present invention.
Figure 20A:
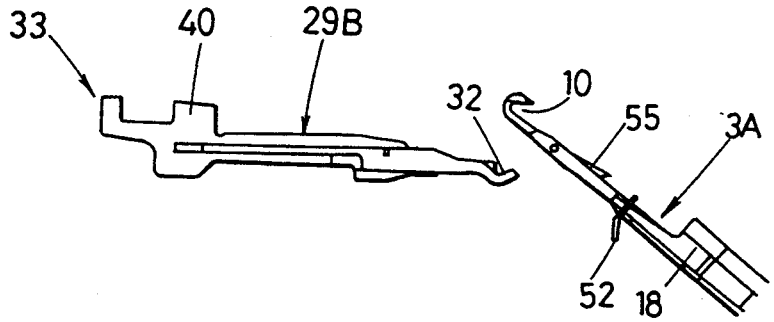
FIGS. 20A through 20D are side view of the relationship between positions of the knitting needle and the transferring jack in each position in FIG. 19.

FIG. 19 and FIG. 20A through FIG. 20D designate the group of cams of the carriage 2A for moving the knitting needles 3A on the front needle bed 4A, and the cam groove 43 on the cam plate 44 for operating the transferring jacks 29B in the rear transferring jack bed 27B. When the carriage 2A is moved on the needle bed 4A from right to left, the butts 15A and 15B of the jack 12 of the knitting needle 3 and the butt 16 of the selecting jack 13 of the knitting needle 3 pass in the group of cams of the carriage 2 from left to right as shown symbols A, B, C, and D in FIG. 19. When the front knitting needle 3A reaches the position A in FIG. 19, the butt 15A of the jack 12 is gradually pushed upwardly by the transferring raising cam 20 and thus the front knitting needle 3A is raised gradually. Therefore, as shown in FIG. 20A, the stitch 52 opens the latch 55 and the stitch 52 is also opened by a opening member 18.

Figure 20B:
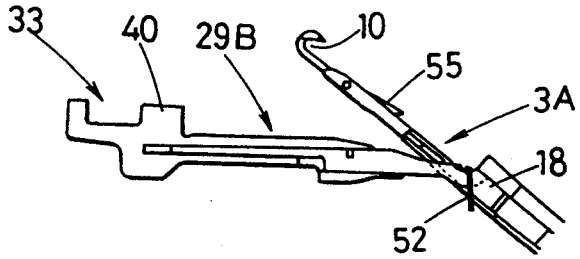

When the front knitting needle 3A reaches the position B in FIG. 19, as shown in FIG. 20B, the front knitting needle 3A is projecting forward mostly and the needle selected butt 40 of the transferring jack 29B is pushed outwardly by the cam groove 43 of the cam plate 44 so to push the transferring jack 29B forward. The stitch engaging portion 32 is guided through the stitch 52 opened by the opening member 18 and then, the stitch engaging portion 32 receives the stitch 52.

Figure 20C:
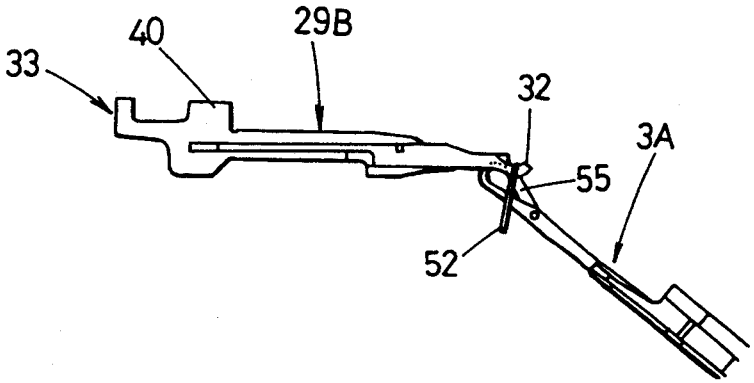

When the front knitting needle 3A reaches the position C in FIG. 19, as shown in FIG. 20C, the front knitting needle 3A is retracted gradually because the butt 15A of the jack 12 is gradually pushed downwardly, and the needle selected butt 40 of the transferring jack 29B is pushed outwardly by the cam groove 43 of the cam plate 44 so that the stitch 52 does not interfere with the latch 55 when the front knitting needle 3A retracts.

Figure 20D:
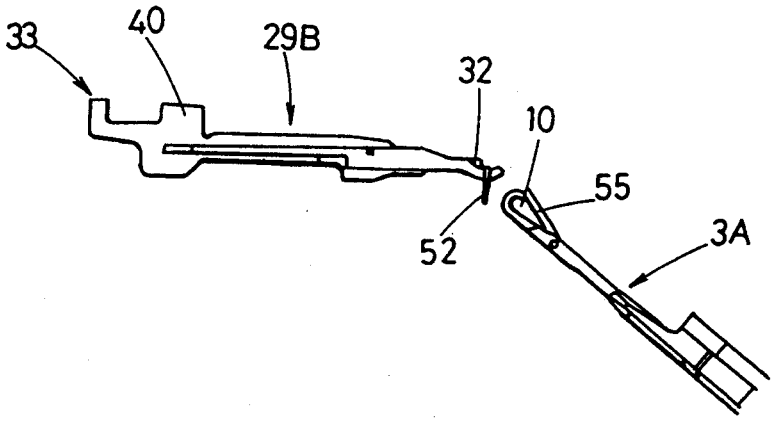

When the front knitting needle 3A reaches the position D in FIG. 19, the butt 15B of the jack 12 passes the convex cam 23. As shown in FIG. 20D, the stitch 52 engaged with the front knitting needle 3A has been transferred from needle 3A to the stitch engaging portion 32 of the transferred from jack 29B.

When the group of cams of the carriage 2A passes the portion where the knitted goods is knitted, the transferring jack 29B keeps the stitch 52 at the stitch engaging portion 32.

Subsequently, the transferring jack bed 27B is moved transversely by predetermined pitches (for example one pitch) by the motor 66 via the driving screw shaft 67, the slider 68, and the move control bracket 71. At this time, because the curved portion 29, formed at the jack body 34 side of the stitch engaging portion 32, is positioned above the protruded member, like the sinker arranged at the aperture between the needle beds 4A and 4B, the transferring jack bed 27B can be moved transverse direction without interfering with the sinker or the knitting needles 3A and 3B.

Subsequently, when the carriage 2A (2B) is moved in an adverse direction along the needle bed 4A (4B), the butts 15A and 15B of the jack 12 of the front knitting needle 3A and the butt 16 of the selecting jack 13 of the knitting needle 3 pass in the group of cams of the carriage 2 from right to left as shown by symbols E, F, G, and H in FIG. 21.

Figure 21:
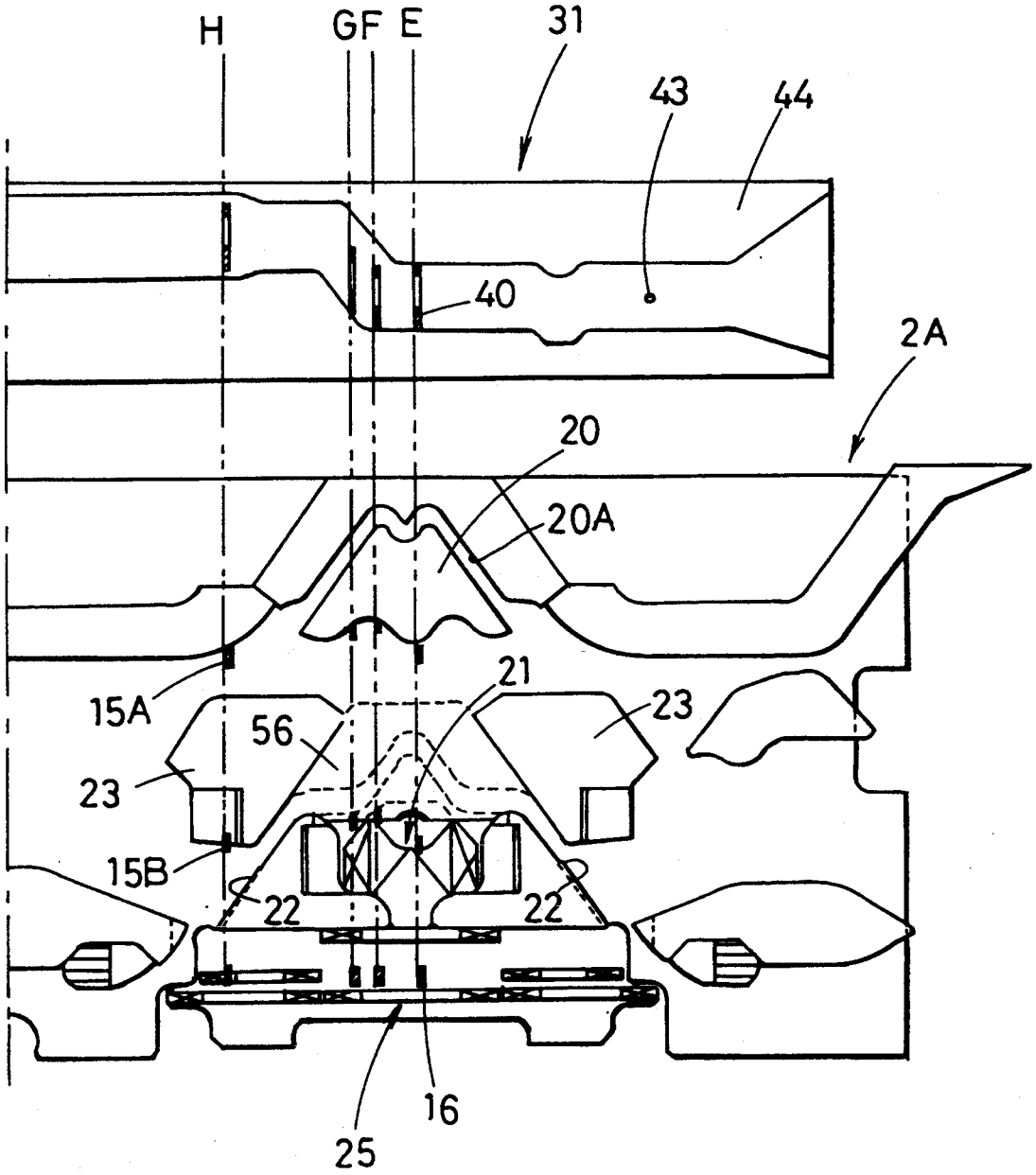
FIG. 21 is an elevational view illustrating the groups of the cams of the carriage and the relationship between positions of the cam groove of the transferring cam and the knitting needle of a flat knitting machine of the present invention.
Figure 22A:
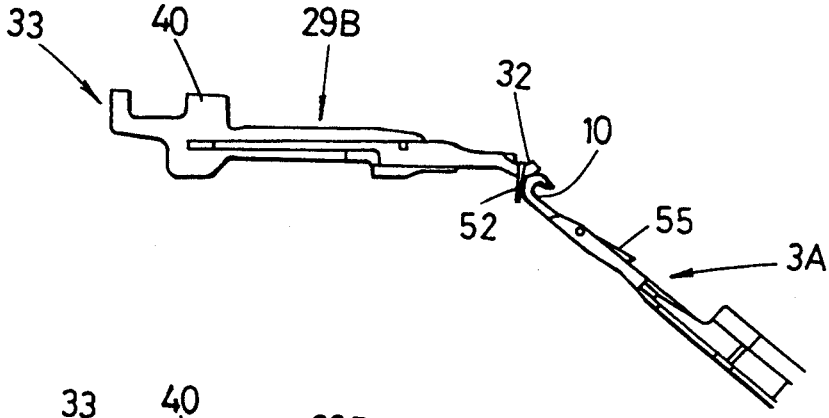
FIGS. 22A through 22D are side view of the relationship between positions of the knitting needle and the transferring jack in each position in FIG. 21.
Figure 22B:
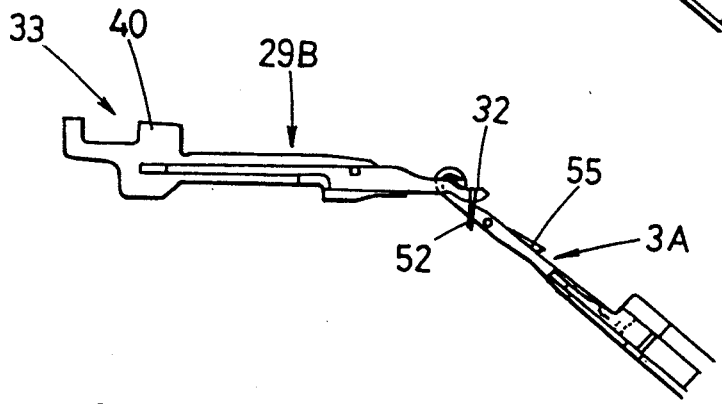

When the front knitting needle 3A, which receives the stitch 52, reaches from the position E to the position F in FIG. 21, as shown in FIG. 22A and FIG. 22B, the butt 15B of the jack 21 is operated by the transferring raising cam 20. the front knitting needle 3A is pushed outwardly, the hook 10 of the front knitting needle 3A is introduced into the needle selected member 32, and the stitch 52 is engaged with hook 10.

Figure 22C:
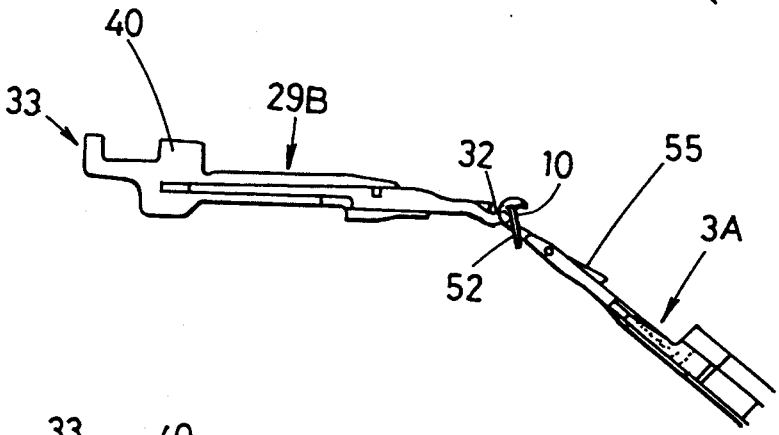

When the front knitting needle 3A reaches the position G in FIG. 21, the front knitting needle 3A is gradually retracted by the transferring raising cam 20, and the transferring jack 29B begins to retract because the needle selected butt 40 of the transferring jack 29B is operated by the cam groove 43 of the cam plate 44. Therefore, as shown in FIG. 22C, the stitch 52 engaged with the stitch engaging portion 32 transferred to the hook 10 of the front knitting needle 3A.

Figure 22D:
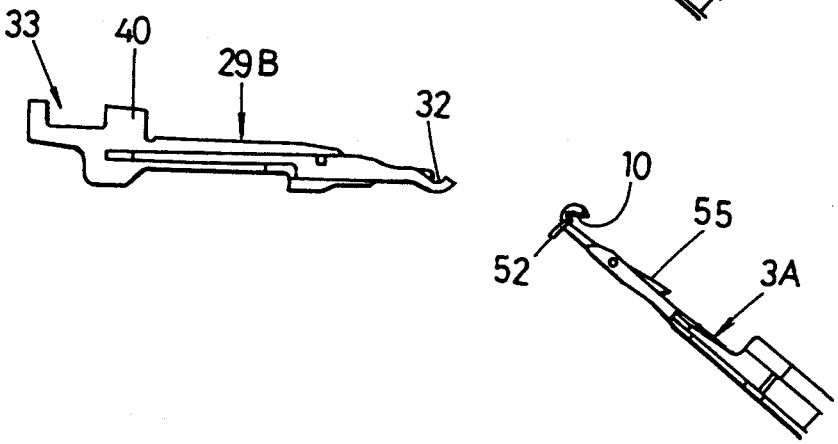

Subsequently, when the front knitting needle reaches the position H in FIG. 21, as shown in FIG. 22D, the transferring jack 29B is retracted further because the needle selected butt 40 of the transferring jack 29B is pushed inwardly by the cam groove 43 of the cam plate 44, the front knitting needle 3A received the stitch 52 is also retracted. As a result, the transfer of the stitch is completed.

When a knitting needles 3A(3B) should be replaced, due to wearing, breakage or whatever reasons, the knitting needle can be easily removed upwardly by pulling out the needle suppressing plate 83 fitted covering all the needle plate 81 long up until the knitting needle to be replaced and opening the space above the knitting needle in question. The needle can be easily inserted from the upside.

Note, in the embodiments, though only the rear needle bed is movable transversely, the front needle bed may be movable transverse direction or both the rear and the front needle beds may be movable transverse. Also, only the transferring jack bed may be movable and only either the rear or the front transferring jack be may be provided.

Figure 14:
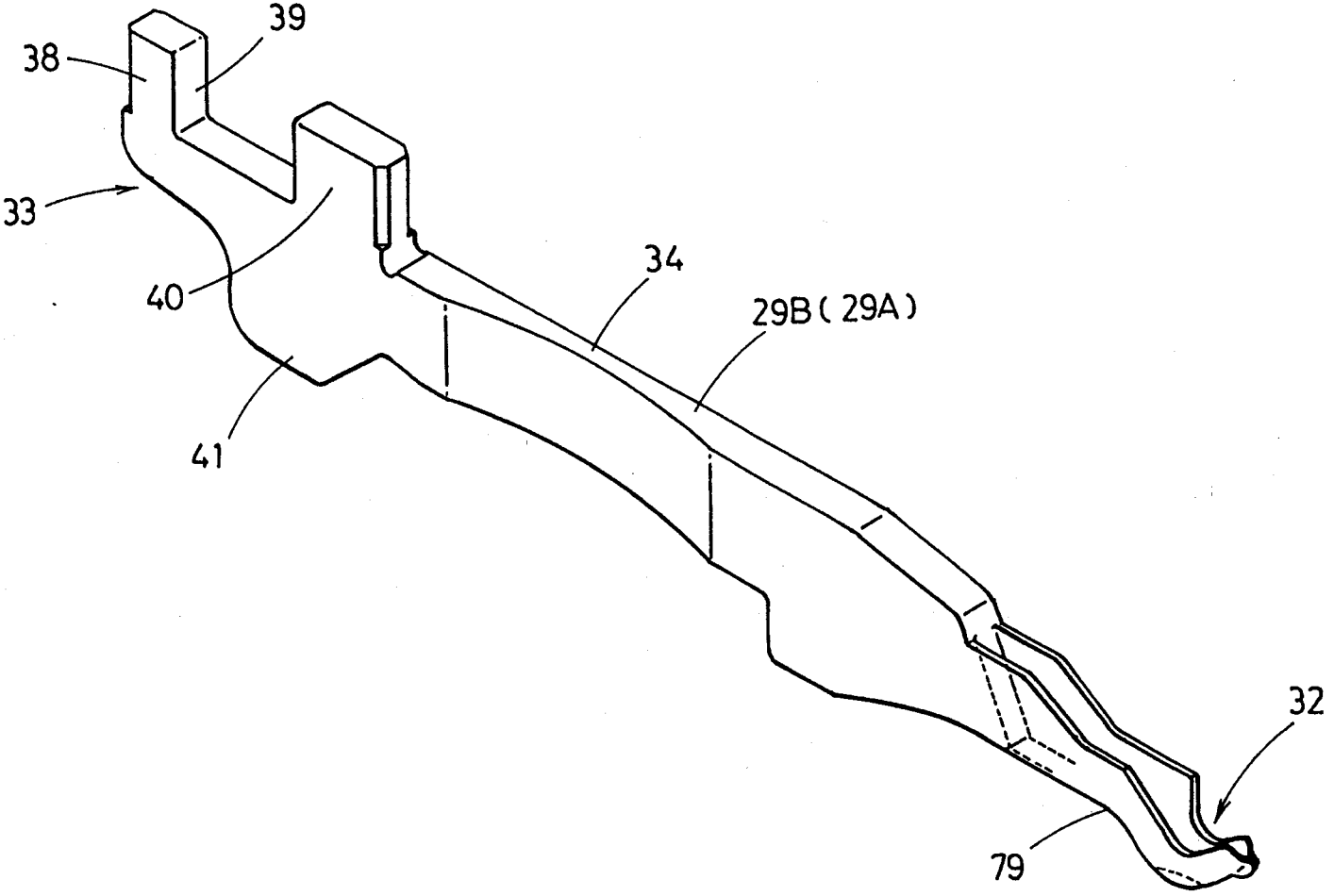
FIG. 14 is a perspective view of other example of a transferring jack of a flat knitting machine of the present invention.

In the above embodiment, a transferring jack is made by mounting an elastic plate member at the both side of the jack body and forming a stitch engaging portion at a distal end of the elastic plate member extruded from the jack body. The stitch engaging portion and the jack body can be integrally formed, as shown in FIG. 14.

Although not shown in the drawing, the dovetail protruding object, shaped in an inverted trapezoid of the supporting part, and the dovetail groove to be fitted the protruding object in the embodiment can be shaped in a circle or a quadrilateral.

Further, the needle bed, or the transferring jack bed disposed above, can be firmly supported by the supporting part.

What is claimed is:

1. A flat knitting machine, comprising:
a needle bed having plate grooves engraved on an upper face of said needle bed;
needle plates, each of which is mounted in each of said plate grooves;
needle grooves formed between said needle plates,
a supporting part attached to and extending upward from a number of specific needle plates; and
a transferring jack bed supported by said supporting part, said transferring jack bed being movable in a longitudinal direction of said needle bed along said supporting part.

2. A flat knitting machine, comprising:
a lower needle bed having plate grooves engraved on an upper face of each of said needle beds;
needle plates, each of which is mounted in each of said plate grooves;
needle grooves formed between said needle plates,
a supporting part attached to and extending upward from a number of specific needle plates; and
an upper needle bed supported by said supporting part, said upper needle bed being movable in a longitudinal direction of said lower needle bed along said supporting part.

3. A flat knitting machine as recited in claim 1, further comprising:
a dovetail protruding object formed in either said supporting part or said transferring jack bed; and
a dovetail groove to fit said dovetail protruding object, formed on an other of said supporting part or said transferring jack bed where said dovetail protruding object is not formed, said dovetail protruding object and said dovetail groove being movably fitted.

4. A flat knitting machine as recited in claim 2, further comprising:
a dovetail protruding object formed in either said supporting part or said upper needle bed; and
a dovetail groove to fit said dovetail protruding object, formed on an other of said supporting part or said upper needle bed where said dovetail protruding object is not formed, said dovetail protruding object and said dovetail groove being movably fitted.

5. A flat knitting machine as recited in claim 3, further comprising a space for removing and mounting said dovetail protruding object, said space being formed in said dovetail groove.

6. A flat knitting machine as recited in claim 4, further comprising a space for removing and mounting said dovetail protruding object, said space being formed in said dovetail groove.

* * * * *